US008844507B2

(12) United States Patent
Kitayama et al.

(10) Patent No.: US 8,844,507 B2
(45) Date of Patent: Sep. 30, 2014

(54) PCV SYSTEM FOR INTERNAL COMBUSTION ENGINE

(75) Inventors: Takeshi Kitayama, Susono (JP); Naoyuki Hayakawa, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 13/993,193

(22) PCT Filed: Jan. 12, 2011

(86) PCT No.: PCT/JP2011/050315

§ 371 (c)(1),
(2), (4) Date: Jun. 11, 2013

(87) PCT Pub. No.: WO2012/095953

PCT Pub. Date: Jul. 19, 2012

(65) Prior Publication Data

US 2013/0291843 A1 Nov. 7, 2013

(51) Int. Cl.
*F02B 25/06* (2006.01)

(52) U.S. Cl.
USPC ..... 123/572

(58) Field of Classification Search
USPC ..... 123/572–574
IPC ..... F01M 13/00,13/02, 13/04, 2013/04, F01M 2013/027
See application file for complete search history.

(56) References Cited

U.S. PATENT DOCUMENTS

| | | | | |
|---|---|---|---|---|
| 5,669,366 | A | 9/1997 | Beach et al. | |
| 8,485,145 | B2 * | 7/2013 | Palumbo | 123/41.86 |
| 2002/0100465 | A1 * | 8/2002 | Pietschner | 123/572 |
| 2005/0061305 | A1 * | 3/2005 | Pietschner | 123/572 |
| 2009/0241922 | A1 | 10/2009 | Okada | |
| 2009/0301446 | A1 | 12/2009 | Asanuma et al. | |

FOREIGN PATENT DOCUMENTS

| | | |
|---|---|---|
| JP | A-10-115212 | 5/1998 |
| JP | A-10-238330 | 9/1998 |
| JP | A-2006-46244 | 2/2006 |
| JP | A-2008/121520 | 5/2008 |
| JP | A-2009-235958 | 10/2009 |
| JP | A-2009-293464 | 12/2009 |
| JP | A-2010-84742 | 4/2010 |
| JP | A-2010-90869 | 4/2010 |
| JP | A-2010-96029 | 4/2010 |
| WO | WO 2008/056213 A2 | 5/2008 |

* cited by examiner

*Primary Examiner* — M. McMahon
(74) *Attorney, Agent, or Firm* — Oliff PLC

(57) ABSTRACT

A PCV system for an internal combustion engine that can suppress occurrence of preignition due to oil inflow into a cylinder is provided. A path switching valve is controlled so that blowby gas flows via a bypass passage, in a preig occurrence region. Thereby, path pressure loss increases, a PCV flow rate is decreased, and blowby gas can be passed through a separator with a high collection efficiency. As a result, an oil takeaway amount can be reduced, and occurrence of preignition due to cylinder oil inflow can be suppressed.

7 Claims, 8 Drawing Sheets

PCV SYSTEM FOR INTERNAL COMBUSTION ENGINE

TECHNICAL FIELD

The present invention relates to a PCV system (positive crankcase ventilation system) for an internal combustion engine.

BACKGROUND ART

There has been conventionally known a PCV system for an internal combustion engine having a communication passage that allows a crankcase of the internal combustion engine and an intake passage of the internal combustion engine to communicate with each other, as disclosed in, for example, Japanese Patent Laid-Open No. 2009-293464. More specifically, the PCV system according to the publication is applied to an internal combustion engine with a supercharger. The PCV system includes the communication passage (first communication passage) which allows the crankcase of an internal combustion engine and the compressor downstream section of the supercharger in the intake passage of the internal combustion engine to communicate with each other, and the communication passage (second communication passage) which allows the crankcase of the internal combustion engine and the compressor upstream section of the supercharger in the intake passage of the internal combustion engine to communicate with each other.

In the configuration like this, the above described conventional PCV system introduces fresh air into the crankcase via the first communication passage at the time of supercharging by the supercharger, and can scavenge the blowby gas in the crankcase into the intake passage via the second communication passage. By the configuration capable of introducing fresh air like this, the blowby gas in the crankcase is smoothly exhausted at the time of supercharging by the supercharger, and oil degradation is prevented.

CITATION LIST

Patent Literature

Patent Literature 1: Japanese Patent Laid-Open No. 2009-293464

Patent Literature 2: Japanese Patent Laid-Open No. 2010-096029

Patent Literature 3: Japanese Patent Laid-Open No. 2010-090869

Patent Literature 4: Japanese Patent Laid-Open No. 2010-084742

Patent Literature 5: Japanese Patent Laid-Open No. 2009-235958

SUMMARY OF INVENTION

Technical Problem

In the PCV system which includes the passage which allows the crankcase and the intake passage to communicate with each other as described above, on the occasion of blowby gas flowing into the intake passage from the crankcase, a part of the oil accumulated in the crankcase is taken away by the blowby gas. The oil which is taken away by the blowby gas returns to the intake passage, and thereafter, flows into the cylinder through the intake passage.

The amount of the oil which is taken away by the blowby gas (oil takeaway amount) tends to be larger, as the return amount of the blowby gas to the intake passage (blowby gas flow rate, a PCV flow rate) to the intake passage from the crankcase is larger. In particular, in a high load operation region, the PCV flow rate relatively becomes high, and in response to this, the oil takeaway amount tends to be large. If the oil inflow into the cylinder like this excessively increases, there arises the fear of causing preignition.

The invention is made to solve the problem as described above, and has an object to provide a PCV system for an internal combustion engine that can suppress occurrence of preignition due to oil inflow into a cylinder.

Solution to Problem

To achieve the above mentioned purpose, a PCV system for an internal combustion engine, comprising:

a PCV path that allows a crankcase of an internal combustion engine and an intake passage of the internal combustion engine to communicate with each other, and allows blowby gas in the crankcase to pass therethrough;

a bypass passage that is connected in parallel to the PCV path;

a valve that is provided between the PCV path and the bypass passage, and changes a flow path of the blowby gas between the PCV path and the bypass passage;

a separator that is provided in the bypass passage; and control means that controls the valve so that the blowby gas can flow into the bypass passage when the internal combustion engine is operated in a predetermined high load range.

A second aspect of the present invention is the PCV system for an internal combustion engine according to the first aspect, further comprising pressure detecting means that detects pressure in an inside of the crankcase, wherein the control means includes bypass control means that controls the valve so that the blowby gas can flow into the PCV path side when the pressure detected by the pressure detecting means is a predetermined value or more, in a case in which the valve is controlled so that the blowby gas flows to the bypass passage.

A third aspect of the present invention is the PCV system for an internal combustion engine according to the second aspect, wherein the control means includes enriching means that makes an air-fuel ratio of the internal combustion engine rich in a case of performing the control by the bypass amount reducing means.

A fourth aspect of the present invention is the PCV system for an internal combustion engine according to any one of the first to third aspects, wherein the control means includes means that determines whether or not a load of the internal combustion engine is a predetermined load or more based on a sensor output value relating to the load of the internal combustion engine, means that determines whether or not an engine speed of the internal combustion engine is in a predetermined low speed range, and means that controls the valve to increase an amount of the blowby gas that flows via the bypass passage based on a premise that the internal combustion engine is operated in the predetermined high load range when the internal combustion engine is operated under the predetermined load or more and the engine speed is in the low speed range.

A fifth aspect of the present invention is the PCV system for an internal combustion engine according to any one of the first to fourth aspects, further comprising:

a check valve that is provided in a region where the PCV path and the bypass passage connect to each other in an orientation to cause blowby gas to flow into the bypass passage.

A sixth aspect of the present invention is the PCV system for an internal combustion engine according to any one of the first to fifth aspects, wherein the internal combustion engine comprises a supercharger, the supercharger includes a compressor provided midway in the intake passage, the PCV path allows the crankcase of the internal combustion engine, and an upstream section of the compressor in the intake passage of the internal combustion engine to communicate with each other, the PCV system further comprising:

a gas passage that allows a head cover of the internal combustion engine, and the upstream section of the intake passage of the internal combustion engine to communicate with each other;

an opening and closing valve that opens and closes the gas passage; and control means that closes the opening and closing valve when the control means controls the valve so that the blowby gas flows to the bypass passage.

A seventh aspect of the present invention is the PCV system for an internal combustion engine according to any one of the first to sixth aspects, wherein the internal combustion engine comprises a supercharger, the supercharger includes a compressor provided midway in the intake passage, the PCV path allows the crankcase of the internal combustion engine, and an upstream section of the compressor in the intake passage of the internal combustion engine to communicate with each other, the PCV system further comprising:

a natural aspiration time PCV path that is a path that allows a downstream section of the compressor of the internal combustion engine and the crankcase of the internal combustion engine to communicate with each other; and a PCV valve that is provided in the natural aspiration time PCV path.

A eighth aspect of the present invention is the PCV system for an internal combustion engine according to any one of the first to seventh aspects, wherein the predetermined high load range is a high load range to such an extent that preignition occurs by oil flowing into a cylinder of the internal combustion engine as a result of the oil taken away from an inside of the crankcase of the internal combustion engine with a flow of blowby gas via the PCV path increasing in response to a load of the internal combustion engine.

Advantageous Effect of Invention

According to the first aspect, when the internal combustion engine is operated in a predetermined high load range, blowby gas can be introduced into a path (namely, a bypass passage) which includes a separator and has pressure loss made relatively high. Thereby, in the side of the high load range which is the region in which the PCV flow rate tends to be high and the cylinder oil inflow amount tends to be large, the PCV flow rate is suppressed to be low and the oil takeaway amount can be reduced. As a result, occurrence of preignition due to cylinder oil inflow can be suppressed.

According to the second aspect, in the light of the presence of the fear that as a result of reduction in the PCV flow rate according to the first aspect, the inside of the crankcase is excessively increased in pressure to cause a harmful effect, the flow path of the blowby gas is returned to the PCV path and use of the bypass passage with high pressure loss can be suspended in order to avoid the harmful effect.

According to the third aspect, instead of the preignition suppression effect being unable to be enjoyed by suspending use of the bypass passage with high pressure loss, the preignition suppression effect can be obtained by increase of the fuel injection amount.

According to the fourth aspect, determination of whether or not the internal combustion engine is operated in a preig occurrence region can be precisely performed, and suppression of preignition due to cylinder oil inflow can be precisely performed.

According to the fifth aspect, the check valve can function to pass the flow of the blowby gas to the side of the bypass passage including the separator and function to close the passage to the backflow thereof.

According to the sixth aspect, in the configuration which can introduce fresh air via the gas passage when the blowby gas is passed to the intake passage via the PCV path at the time of supercharging, the gas path can be closed at the time of introduction of the blowby gas to the bypass passage according to the first aspect.

According to the seventh aspect, in the PCV system which includes the PCV path which is used at the time of supercharging and the PCV path which is used at the time of natural aspiration, respectively, the flow of the blowby gas to the compressor upstream section of the supercharger can be properly controlled.

According to the eighth aspect, the region where preignition occurs is accurately set as a predetermined high load range, and when the internal combustion engine is operated in the preignition occurrence region, the bypass passage which includes the separator and has the pressure loss made relatively high can be used. As a result, preignition can be suppressed more precisely. Further, the preignition occurrence region is accurately set, and therefore, even when the internal combustion engine is in a high load range to a certain extent, the measure of not performing introduction of blowby gas to the bypass passage side can be taken when it is unnecessary from the viewpoint of suppressing preignition due to oil inflow into the cylinder.

DESCRIPTION OF EMBODIMENTS

Embodiment 1

Configuration of Embodiment 1

Figure 1:
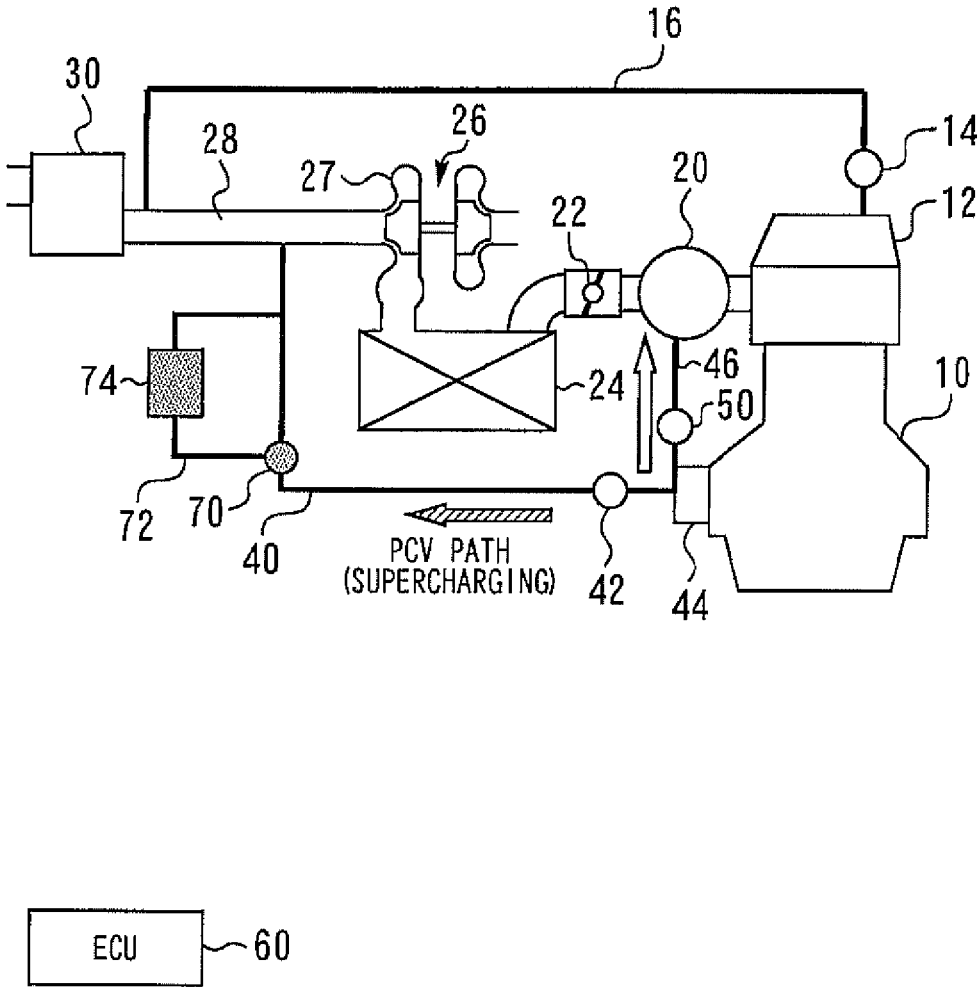
FIG. 1 is a diagram showing a configuration of a PCV system (positive crankcase ventilation system) of an internal combustion engine according to embodiment 1 of the present invention.

FIG. 1 is a diagram showing a configuration of a PCV system (positive crankcase ventilation system) of an internal combustion engine according to embodiment 1 of the present invention. The PCV system according to embodiment 1 is favorably used in a vehicle internal combustion engine. The PCV system according to embodiment 1 is applied to an internal combustion engine 10. The internal combustion engine 10 includes a head cover 12, a cylinder head, a cylinder block, a crankcase and an oil pan. In an inside thereof, a piston and a crankshaft are included.

Note that the internal combustion engine 10 according to embodiment 1 is also a supercharged internal combustion engine, and more specifically has a turbocharger 26 as a supercharger. The internal combustion engine 10 is an automobile internal combustion engine, and may be an ordinary multiple-cylinder internal combustion engine, and the number of cylinders thereof and a method are not limited.

An intake manifold 20 communicates with an intake port of the cylinder head in the internal combustion engine 10. The intake manifold 20 communicates with an intercooler 24. Between them, a throttle valve 22 is included. An upstream of the intercooler 24 communicates with an intake passage upstream section 28 via a compressor 27 of the turbocharger 26. The intake passage upstream section 28 connects to an air cleaner 30.

The head cover 12 and the intake passage upstream section 28 communicate with each other via a fresh air introduction path 16. The fresh air introduction path 16 is provided with a valve 14 that switches opening and closing thereof. By opening the valve 14, a state in which fresh air can be introduced into the head cover 12 (into the crankcase which communicates with this) via the fresh air introduction path 16 can be created. Introduction of fresh air is enabled like this, whereby scavenging of the blowby gas in the crankcase of the internal combustion engine 10 (namely, ventilation in the crankcase) can be smoothly performed.

To the crankcase of the internal combustion engine 10, a PCV path 40 that is a passage of blowby gas is connected. The PCV path 40 allows the crankcase of the internal combustion engine 10 and the intake passage upstream section 28 to communicate with each other. A separator 44 is interposed between the PCV path 40 and the crankcase of the internal combustion engine 10. The PCV path 40 is provided with a check valve 42. The PCV path 40 functions as a PCV channel at a time of supercharging. A flow direction of the blowby gas at the time of supercharging is shown by the arrow of "PCV path (at the time of supercharging)" in FIG. 1.

In the PCV system according to embodiment 1, a bypass passage 72 is connected in parallel to the PCV path 40. The bypass passage 72 is provided with a separator 74. Further, in a connection portion of the PCV path 40 and the bypass passage 72, a path switching valve 70 is provided. By controlling the path switching valve 70, the path which introduces blowby gas can be switched from the PCV path 40 to the path with high pressure loss via the separator 74. According to the configuration like this, the communication path of blowby gas can be changed so as to pass the blowby gas via the bypass passage 72 in accordance with necessity. In the PCV system according to embodiment 1, the separator 74 is a separator having a high collection efficiency. Thereby, the takeaway amount of oil can be reliably suppressed.

The PCV system for an internal combustion engine according to embodiment 1 also includes a PCV path 46, other than the PCV path 40. Via the PCV path 46, the intake manifold 20 and the PCV path 40 communicate with each other. The PCV path 46 is provided with a PCV valve 50. The PCV path 46 functions as a PCV path at a time of NA (Natural Aspiration).

The PCV system according to embodiment 1 is controlled by an ECU (Electronic Control Unit) 60. The ECU 60 connects to the path switching valve 70, and can issue a control signal for controlling directions of opening and closing of the path switching valve 70 (directions in which the blowby gas is caused to flow).

Note that in embodiment 1, in the internal combustion engine 10, various sensors relating to operation of the internal combustion engine, that are an air flow meter, an intake pressure sensor, a crank angle sensor, a throttle opening sensor, an engine speed sensor, an engine water temperature sensor, an exhaust gas sensor such as an air-fuel ratio sensor, an accelerator position sensor and other sensors are properly included in accordance with a specific configuration of the internal combustion engine 10, though not illustrated. The ECU 60 connects to various sensors not illustrated as above to detect an operation state of the engine (engine speed, a load and the like), and connects to various devices relating to operation of the internal combustion engine 10 (more specifically, a fuel injection valve, a variable valve lift timing mechanism and the like) to manipulate the actuators. The ECU 60 processes a signal from each of the sensors included in the internal combustion engine 10, and reflects the processing result in operation of the respective actuators.

[Operation of Embodiment 1]

Figure 2:
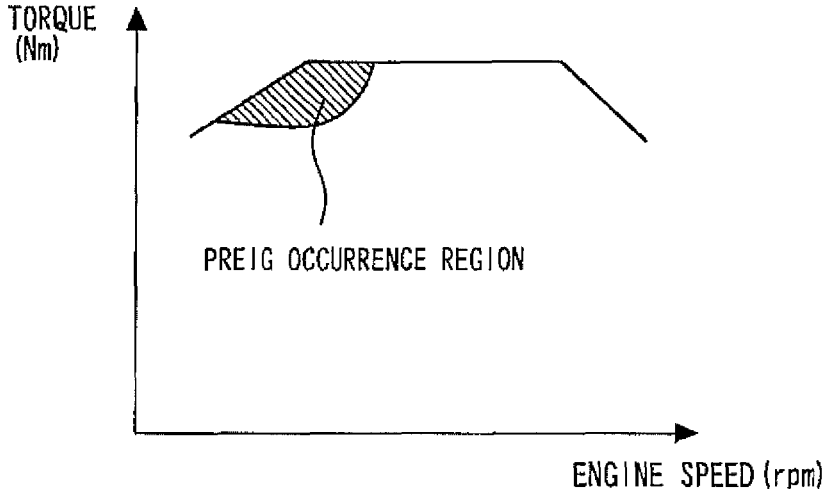
FIG. 2 is a diagram for explaining an operation of the PCV system for the internal combustion engine according to embodiment 1 of the present invention.

FIG. 2 is a diagram for explaining an operation of the PCV system for the internal combustion engine according to embodiment 1 of the present invention. In a high load operating region, a PCV flow rate becomes relatively high, and in response to this, the oil takeaway amount easily becomes large. If the oil takeaway amount is significantly large, a cylinder inflow oil amount increases to such an extent that preignition due to cylinder oil inflow occurs. In embodiment 1, as one example of a region which is likely to cause preignition due to cylinder oil inflow like this (hereinafter, also called "preig occurrence region"), a constant region in a low engine speed/high load range is partitioned and shown in FIG. 2.

In embodiment 1, in the preig occurrence region, the path switching valve 70 is controlled so that the blowby gas flows via the bypass passage 72. Thereby, path pressure loss is increased, the PCV flow rate is decreased, and the blowby gas can be passed through the separator 74 with a high collection efficiency. As a result, the oil takeaway amount can be reduced, and occurrence of preignition due to cylinder oil inflow can be suppressed.

Note that in embodiment 1, in a state in which the path switching valve 70 is switched as described above, the valve 14 is closed to cut off the fresh air introduction path 16 in order to prevent the blowby gas from flowing back in the fresh air introduction path 16. This is because if the flow path of the blowby gas is switched to the bypass path including the separator with high pressure loss, an inside of the PCV path with separator to crankcase inner pressure is under high pressure, and therefore, if the fresh air introduction path 16 is not closed, backflow of the blowby gas from the fresh air introduction path 16 is feared.

Meanwhile, in embodiment 1, the path switching valve 70 is controlled so as to close the bypass passage 72, in an operation region other than the preig occurrence region described above. As a result, with use of the PCV path 40 in the operation region other than the preig occurrence region, scavenging in the crankcase of the internal combustion engine 10 is performed, an NOx concentration is reduced, and oil degradation can be suppressed.

[Specific Processing of Embodiment 1]

Figure 3:
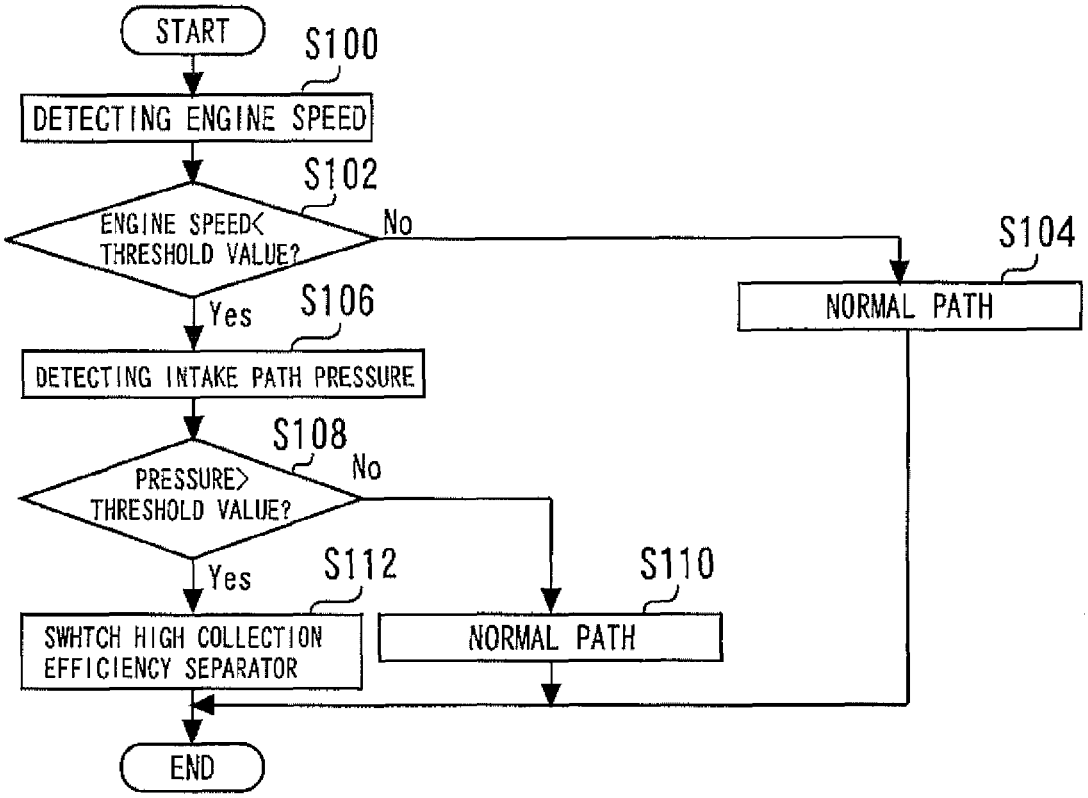
FIG. 3 is a flowchart of a routine executed by an ECU in embodiment 1 of the present invention.

Hereinafter, specific processing executed in the PCV system according to embodiment 1 of the present invention will be described with use of FIG. 3. FIG. 3 is a flowchart of a routine executed by the ECU 60 in embodiment 1 of the present invention.

In the routine shown in FIG. 3, the ECU 60 executes processing for detecting an engine speed first (step S100). As for detection of the engine speed, the ECU 60 can calculate the engine speed based on a sensor output value of an engine speed sensor or the like not illustrated.

Next, the ECU 60 executes processing of determining whether or not the engine speed detected in step S100 is below a predetermined threshold value (S102). As schematically shown in FIG. 2, in the low engine speed/high load region in which the PCV flow rate increases, increase in cylinder inflow oil that becomes the cause of preignition is caused. Therefore, in embodiment 1, it is determined whether or not the engine speed belongs to a low engine speed range by comparison with a first threshold value that is set in advance.

When the determination result is No in this step, the PCV path is kept to be a normal path (namely, the path with only the PCV path 40 without a medium of the bypass passage 72) (step S104), and thereafter, the routine of this time is finished.

When the determination result is Yes in step S102, the ECU 60 subsequently executes processing for detecting intake pipe pressure (step S106). In this step, based on an output value of an intake pressure sensor or the like not illustrated, pressure in the intake passage of the internal combustion engine 10 is detected.

Next, the ECU 60 executes processing of determining whether or not the value of the intake pipe pressure detected in step S106 exceeds a predetermined threshold value (S108). As schematically shown in FIG. 2, in the low engine speed/high load region in which the PCV flow rate increases, increase in the cylinder inflow oil that becomes the cause of preignition is caused. Accordingly, in embodiment 1, it is determined whether or not the internal combustion engine 10 is operated in such a high load range as to belong the preig occurrence region based on a magnitude of the intake pipe pressure, by comparing a second threshold value that is set in advance and the intake pipe pressure.

When the determination result is No in this step, the PCV path is kept to be the normal path (namely, the path with only the PCV path 40, without the medium of the bypass passage 72) (step S110), and thereafter, the routine of this time is ended.

When the determination result is Yes in step S108, the ECU 60 executes control processing of switching the path switching valve 70 so as to introduce the blowby gas to the bypass passage 72 having the separator 74 (step S112). Thereby, when the engine speed is lower than a predetermined threshold value (step S102), and the intake pipe pressure is higher than a predetermined threshold value (step S112), the path of the blowby gas can be changed to the separator 74 side.

According to the above processing, when the internal combustion engine 10 is in such a high load range as to belong to the preig occurrence region, the blowby gas can be introduced to the path which includes the separator 74 and has the pressure loss made relatively high. Thereby, at the side of the high load range which is the region where the PCV flow rate tends to increase, the PCV flow rate is suppressed to be low, and the oil takeaway amount can be reduced, as a result of which, occurrence of preignition due to cylinder oil inflow can be suppressed.

Note that in embodiment 1 described above, the PCV path 40 corresponds to "PCV path" in the aforementioned first aspect, the bypass passage 72 corresponds to "bypass passage" in the aforementioned first aspect, the path switching valve 70 corresponds to "valve" in the aforementioned first aspect, and the separator 74 corresponds to "separator" in the aforementioned first aspect, respectively. Further, in embodiment 1 described above, the ECU 60 executes the processing of the flowchart of FIG. 3, whereby "control means" in the aforementioned first aspect is realized.

[Modification of Embodiment 1]

In embodiment 1 described above, it is determined whether or not the internal combustion engine 10 is operated in such a high load range as to belong to the preig occurrence region based on the magnitude of the intake pipe pressure. However, when determination of whether the internal combustion engine is operated in a predetermined high load range is performed, the determination also can be performed with use of information such as an intake air amount and a throttle opening other than the intake pipe pressure.

(Modification 1)

Figure 4:
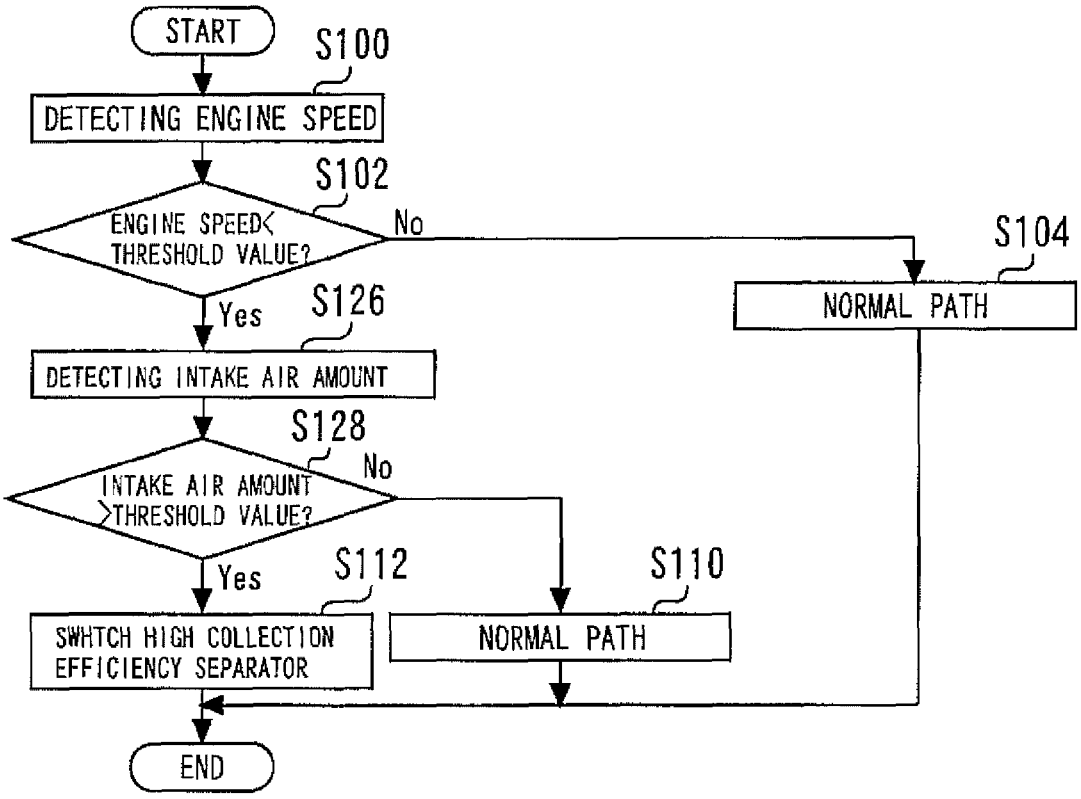
FIG. 4 is a diagram showing a modification of the PCV system for an internal combustion engine according to embodiment 1 of the present invention, and shows a flowchart of a routine that the ECU executes in the present modification.

Accordingly, in modification 1 that will be described as follows, it is determined whether or not the internal combustion engine 10 is operated in such a high load range as to belong to the preig occurrence region, based on an intake air amount, in place of the intake pipe pressure. FIG. 4 is a diagram showing a modification of the PCV system for an internal combustion engine according to embodiment 1 of the present invention, and shows a flowchart of a routine that the ECU 60 executes in the present modification.

In the routine of FIG. 4, similarly to the specific processing (FIG. 3) according to embodiment 1, the processing of steps S100, S102 and S104 is properly executed first. When establishment (Yes) of the condition of step S102 is recognized, the ECU 60 subsequently executes processing of detecting the intake air amount (step S126). In this step, the intake air amount of the internal combustion engine 10 is detected based on an output value of a sensor such as an air flow meter not illustrated, for example.

Next, the ECU 60 executes processing of determining whether or not the intake air amount detected in step S126 exceeds a predetermined threshold value (S128). When the determination result is No in this step, the PCV path is kept to be the normal path (namely, the path with only the PCV path 40 without the medium of the bypass passage 72) similarly to step S110 in the specific processing of embodiment 1 described above, and thereafter, the routine of this time is finished.

When the determination result is Yes in step S128, the ECU 60 executes control processing of switching the path switching valve 70 so as to introduce blowby gas to the bypass passage 72 having the separator 74 similarly to step S112 in the specific processing of embodiment 1 described above (step S112).

According to the above processing, when the internal combustion engine 10 is in the predetermined high load range, the blowby gas can be introduced to the path which includes the separator 74 and has pressure loss made relatively high, similarly to the specific processing described with use of FIG. 3.

(Modification 2)

Figure 5:
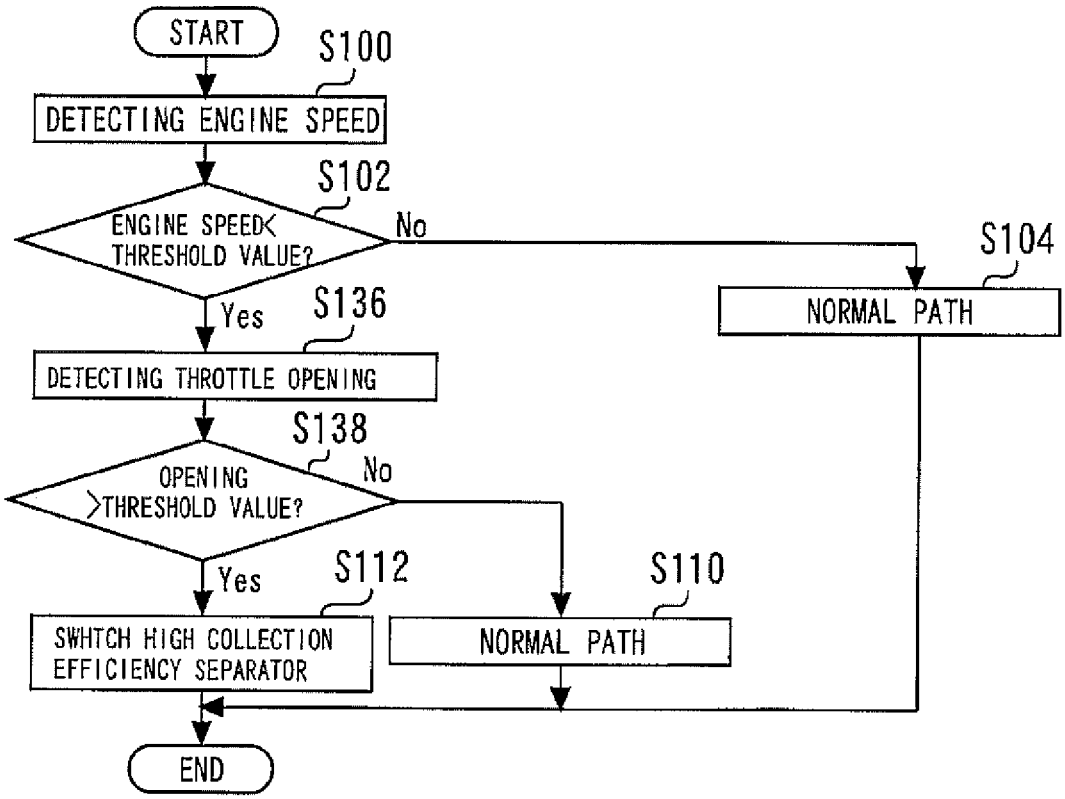
FIG. 5 is a diagram showing a modification of the PCV system for an internal combustion engine according to embodiment 1 of the present invention, and shows a flowchart of a routine that the ECU executes in the present modification.

Subsequently, in modification 2, it is determined whether or not the internal combustion engine 10 is operated in such a high load range as to belong to the preig occurrence region, based on a throttle opening, in place of the intake pipe pressure. FIG. 5 is a diagram showing a modification of the PCV system for an internal combustion engine according to embodiment 1 of the present invention, and shows a flowchart of a routine that the ECU 60 executes in the present modification.

In the routine of FIG. 5, similarly to the specific processing (FIG. 3) according to embodiment 1, the processing of steps S100, S102 and S104 is properly executed first. When establishment (Yes) of the condition of step S102 is recognized, the ECU 60 subsequently executes processing of detecting the throttle opening (step S136). In this step, the opening of the throttle valve 22 is acquired based on an output value of a throttle opening sensor not illustrated, for example.

Next, the ECU 60 executes processing of determining whether or not the throttle opening detected in step S136 exceeds a predetermined threshold value (S138). When the determination result is No in this step, the PCV path is kept to be the normal path (namely, the path with only the PCV path 40 without the medium of the bypass passage 72) similarly to step S110 in the specific processing of embodiment 1 described above, and thereafter, the routine of this time is finished.

When the determination result is Yes in step S138, the ECU 60 executes control processing of switching the path switching valve 70 so as to introduce blowby gas to the bypass passage 72 having the separator 74 similarly to step S112 in the specific processing of embodiment 1 described above (step S112).

According to the above processing, when the internal combustion engine 10 is in the predetermined high load range, the blowby gas can be introduced to the path which includes the separator 74 and has pressure loss made relatively high, similarly to the specific processing described with use of FIG. 3.

Note that in the specific processing according to embodiment 1, in steps S102 and S108, it is determined whether the operation region of the internal combustion engine 10 belongs to the preig occurrence region by performing comparison of the engine speed and the intake pipe pressure with predetermined threshold values respectively. However, the present invention is not limited to this.

As one example is shown in FIG. 2, a boundary of the preig occurrence region can be in a shape including a curve instead of a simple rectangle in the diagram in which torque and the engine speed are the orthogonal coordinate axes. Determination of whether or not the operation region of the internal combustion engine 10 belongs to the preig occurrence region (also called "determination of whether or not belonging to preig occurrence region") may be performed so that the shape of the preig occurrence region is accurately reflected in the determination result. For example, a function that outputs the result of the determination of whether or not belonging to preig occurrence region with the engine speed and the engine load (the intake pipe pressure, the intake air amount, the throttle opening or the like) set as two input values may be created, and the function may be realized by using a map or the like. Alternatively, a threshold value relating to the engine speed determination, and a threshold value relating to load determination may be properly corrected so that change of the boundary of the preig occurrence region as illustrated in FIG. 2 is reflected. Thereby, determination of whether or not the operation region belongs to the preig occurrence region may be performed more precisely.

(Modification 3)

Figure 6:
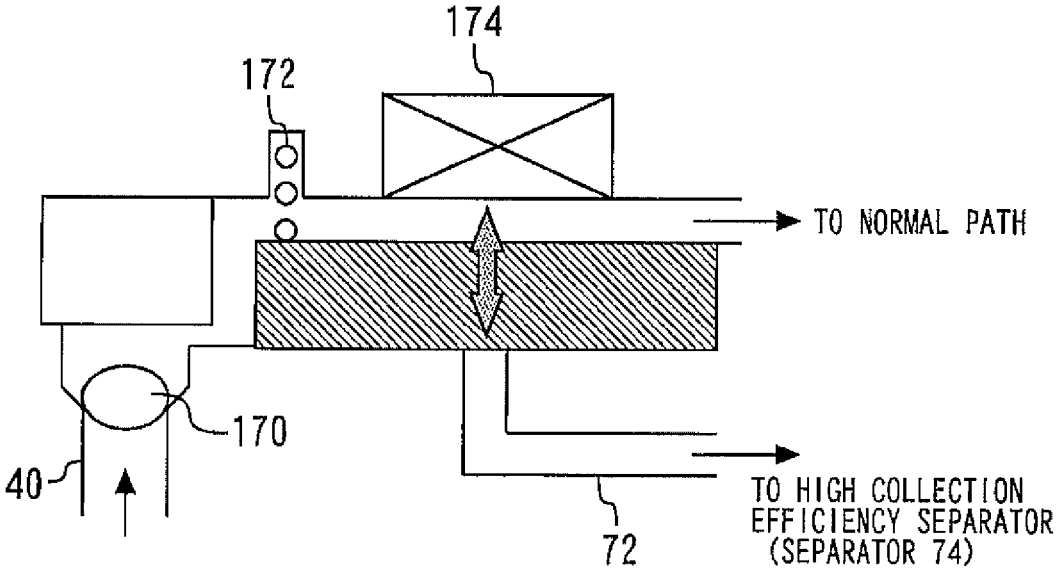
FIG. 6 is a diagram showing a configuration of a modification of the PCV system for the internal combustion engine according to embodiment 1 of the present invention.

FIG. 6 is a diagram showing a configuration of a modification of the PCV system for the internal combustion engine according to embodiment 1 of the present invention. In modification 3 described here, an integral valve, in which a function of a check valve is added to the path switching valve 70, is provided in a connection portion of the PCV path 40 and the bypass passage 72. Note that for convenience, the illustration directions on the page with respect to the PCV path 40 and the bypass passage 72 differ between FIG. 6 and FIG. 1. As shown in FIG. 6, a check valve 170, a spring 172 and an electromagnetic valve 174 are provided. The ECU 60 is connected to the electromagnetic valve 174, and can control opening and closing of the electromagnetic valve 174. The control content of the electromagnetic valve 174 can be made the content similar to the switching processing (steps S104, S110 and S112) of the path switching valve 70 in FIGS. 3, 4 and 5 described above, and the path of the blowby gas can be switched between the normal path and the separator 74 side path, in response to the result of the determination of whether or not belonging to the preig occurrence region.

Note that in FIG. 1 showing the configuration of embodiment 1 described above, the configuration of the PCV system for the internal combustion engine according to embodiment 1 is schematically shown in such a manner that the bypass passage 72 is connected in parallel to the PCV path 40 in a region downstream to a certain extent of the PCV path 40. However, the present invention is not limited to this, and a position where the bypass passage 72 and the PCV path 40 are connected (namely, the position where the PCV path 40 branches to the bypass passage 72, the mounting position of the path switching valve 70 by extension) may be a side nearer to the internal combustion engine 10 (crankcase side) than the position schematically shown in FIG. 1. Alternatively, the PCV path 40 and the bypass passage 72 are arranged in parallel and respectively allow the crankcase and the intake passage upstream section 28 to communicate with each other, valves are provided at the PCV path 40 and the bypass passage 72 respectively, and one of these two may be selectively opened. The configuration like this is also the configuration in which the PCV path 40 and the bypass passage 72 are connected in parallel, and therefore, is included in "PCV path" and "bypass passage connected in parallel to the PCV path" in the aforesaid first invention.

Embodiment 2

Configuration of Embodiment 2

Figure 7:
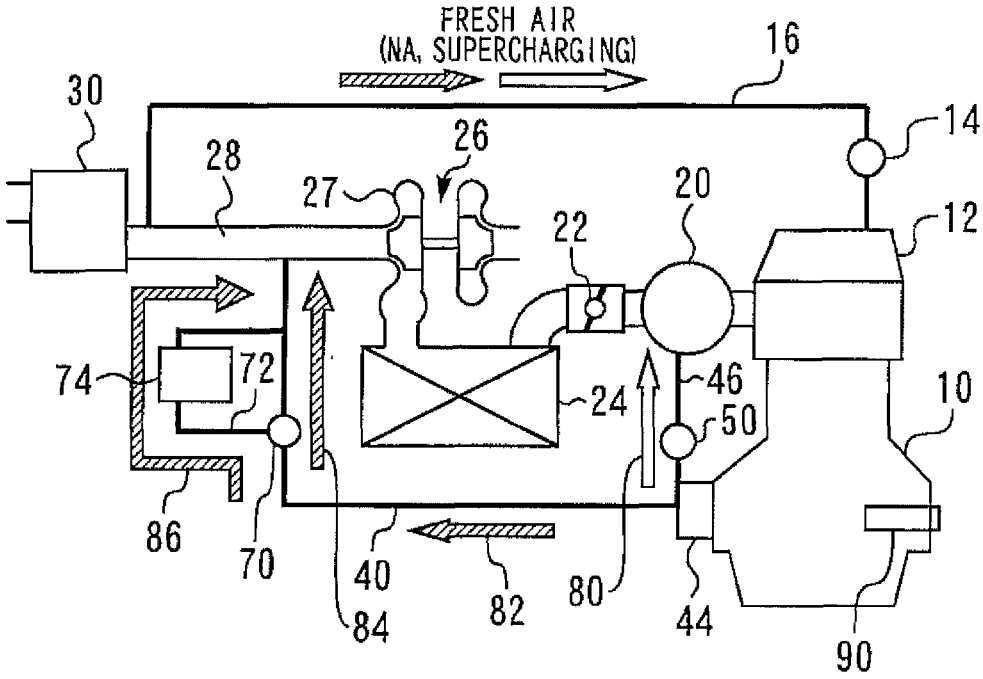
FIG. 7 is a diagram showing a configuration of a PCV system for an internal combustion engine according to embodiment 2 of the present invention.
Figure 7:
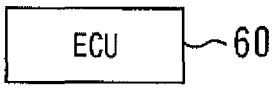

FIG. 7 is a diagram showing a configuration of a PCV system for an internal combustion engine according to embodiment 2 of the present invention. The configuration of embodiment 2 is similar to the configuration of embodiment 1 except for a feature of including a pressure sensor 90 for sensing pressure in the crankcase of the internal combustion engine 10 and a feature of the check valve 42 being not included in the PCV path 40. However, the check valve 42 may be provided at the PCV system for an internal combustion engine according to embodiment 2 in accordance with necessity.

In FIG. 7, an arrow 80 shows a flow of blowby gas at a time of NA in the PCV system for an internal combustion engine according to the present embodiment. Meanwhile, arrows 82, 84 and 86 of FIG. 7 show flows of the blowby gas at a time of supercharging in the PCV system for an internal combustion engine according to the present embodiment. Among the arrows 82, 84 and 86, the arrow 84 shows the flow of the blowby gas at a normal time (the case of not being the preig occurrence region), and the arrow 86 shows the flow of the blowby gas at the time of the preig occurrence region. Note that with respect to the flow of the fresh air in the fresh air introduction path 16, the direction of flowing to the head cover 12 from the intake passage upstream section 28 is the normal direction, at both the NA time and the supercharging time.

According to the PCV system according to embodiment 1, the PCV path is switched to the separator 74 side and the fresh air introduction path 16 can be closed in the preig occurrence region. However, when the operation like this is performed, pressure loss at the bypass passage 72 side is high, and therefore, the pressure in the crankcase of the internal combustion engine 10 increases. When the pressure in the crankcase becomes excessively high, oil leakage is likely to occur from the oil seal section due to this. Thus, in the PCV system for an internal combustion engine according to embodiment 2, the flow path of the blowby gas is returned to the PCV path 40 and use of the bypass passage 72 with high pressure loss is suspended, in accordance with necessity, in order to avoid the crankcase inner pressure being excessively high.

Figure 8:
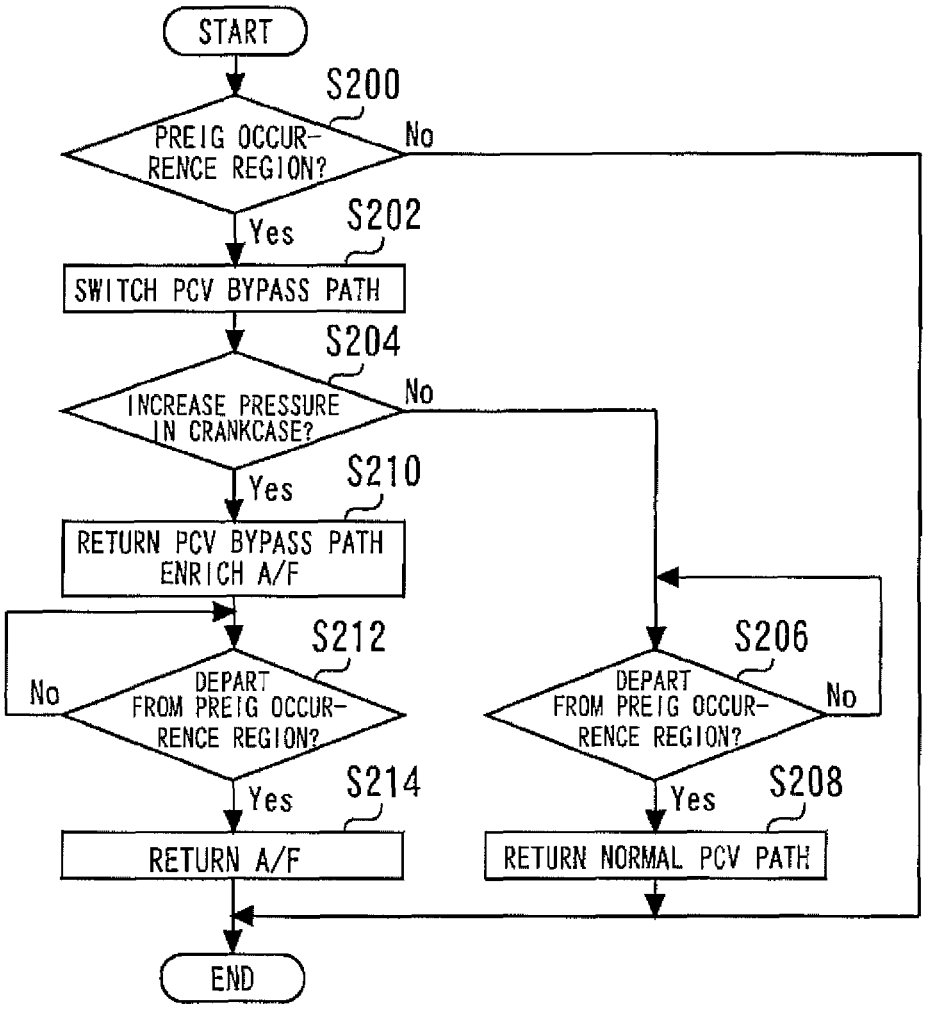
FIG. 8 is a flowchart of a routine executed by the ECU in embodiment 2 of the present invention.

FIG. 8 is a flowchart of a routine executed by the ECU in embodiment 2 of the present invention.

In the routine of FIG. 8, the ECU 60 firstly executes processing of performing determination of whether the operation region of the internal combustion engine 10 belongs to the preig occurrence region (also called "determination of whether or not belonging to preig occurrence region") (step S200). In this step, the determination of whether or not belonging to the preig occurrence region can be performed with use of the method (refer to FIGS. 3, 4, 5 and the like) described in the specific processing according to embodiment 1 or the modifications of embodiment 1 described above.

When the determination result of step S200 is No, that is, in the operation region other than the preig occurrence region, the path switching valve 70 is controlled to close the bypass passage 72 as described in "operation of embodiment 1".

When the determination result of step S200 is Yes, the path of the blowby gas is switched to the bypass passage 72, and the valve 14 is closed to cut off the fresh air introduction path 16. In response to this, the blowby gas advances in the path shown by the arrows 82 and 86 in FIG. 7. As a result, the same function as realized in the PCV system of the internal combustion engine according to embodiment 1, that is, the function of being capable of introducing the blowby gas to the path that includes the separator 74 and has the pressure loss made relatively high when the internal combustion engine 10 is in such a high load range as to belong to the preig occurrence region is similarly realized in the PCV system of the internal combustion engine according to embodiment 2.

Next, the ECU 60 executes determination processing with respect to increase in the crankcase internal pressure (step S204). More specifically, in this step, the value of the crankcase internal pressure of the internal combustion engine 10 is detected based on an output value of the pressure sensor 90, and it is subsequently determined whether or not the detected pressure value exceeds a predetermined threshold value.

When the determination result of step S204 is Yes, the ECU 60 performs control of the path switching valve 70 to return the path of the blowby gas to the PCV path 40 from the bypass passage 72, and executes processing of making the A/F rich (more specifically, increase of the fuel injection amount) (step S210).

By the processing of step S210, the flow path of the blowby gas is returned to the PCV path, and use of the bypass passage with high pressure loss can be suspended, so as to avoid the crankcase internal pressure becoming excessively high.

Furthermore, in the specific processing according to embodiment 2, in step S210, the A/F is made rich simultaneously with switching of the path of the blowby gas. The A/F which is made rich reduces the cylinder internal temperature, whereby occurrence of preignition can be suppressed. As a result, the preignition suppression effect can be enjoyed by making the A/F rich (more specifically, increase of the fuel injection amount in embodiment 2), instead of the preignition suppression effect being unable to be enjoyed by suspending use of the bypass passage with high pressure loss.

Next, the ECU 60 executes processing of determining whether or not the operation region of the internal combustion engine 10 departs from the preig occurrence region (step S212). In this step, the determination of whether or not belonging to the preig occurrence region with respect to an engine speed range and a load range is performed similarly to the determination in step S200 described above, for example. Thereby, it can be confirmed that departure from the preig occurrence region takes place by the operation region of the internal combustion engine 10 changing or the like after the A/F is made rich. When the determination result in step S212 is No, the ECU 60 repeatedly executes the determination processing of S212 (for example, each preset time period) until the determination result of S212 becomes Yes.

When the determination result of step S212 is Yes, the ECU 60 executes processing of returning the A/F to an original value (step S214). More specifically, in this step, the ECU 60 finishes the control of making the A/F rich which is performed in step S210 described above, and restarts normal air-fuel ratio control which is performed before the processing of S210. Thereby, when there is no fear of occurrence of preignition after departure from the preig occurrence region, making the A/F rich which is performed for the purpose of suppression of preig can be quickly finished. Thereafter, the routine of this time is ended.

Meanwhile, when the determination result of step S204 is No, the ECU 60 executes processing of determining whether or not the operation region of the internal combustion engine 10 departs from the preig occurrence region while keeping the state of introducing the blowby gas to the bypass passage 72 (step S206). The specific processing content in this step can be made the same content as in step S212. When the determination result in step S206 is No, the ECU 60 repeatedly (for example, at each preset time period) executes the determination processing of S206 until the determination result of S212 becomes Yes.

When the determination result of step S206 is Yes, the ECU 60 executes the control processing of switching the path switching valve 70 to return the path of the blowby gas to the PCV path 40 side from the bypass passage 72 side (step S208). Thereby, when there is no fear of occurrence of preignition after departure from the preig occurrence region, the introduction path of the blowby gas can be quickly returned to the path of the normal path. Note that at this time, the valve 14 is opened, and the fresh air introduction path 16 which is switched to a cutoff state at the time of start of use of the bypass passage 72 may be opened. Thereafter, the routine of this time is ended.

According to the above processing, the flow path of the blowby gas is returned to the PCV path 40, and use of the bypass passage 72 with high pressure loss can be suspended in accordance with necessity so that the crankcase internal pressure is prevented from being excessively high during use of the bypass passage 72 which is the path with high pressure loss. Further, instead of the bypass pass 72 being unable to be used, suppression of preig can be achieved by making the A/F rich.

Note that in the routine of FIG. 8 described above, the processing is divided into the processing of step S210 and the following steps, and processing of step S206 and the following step, in accordance with the result of the determination of increase in the crankcase internal pressure in step S204. However, the present invention is not limited to only the specific processing like this. For example, when the determination result is No in step S206, the processing may be returned to step S204. In this case, when the determination result in step S206 is No, step S204 is subsequently performed again, and the processing is branched to any one of S210 and S206 in response to the determination result (namely, whether or not the crankcase internal pressure exceeds the predetermined threshold value). In this manner, the determination about the increase in the crankcase internal pressure may be repeatedly performed.

Note that in embodiment 2 described above, the pressure sensor 90 corresponds to "pressure detecting means" in the aforementioned second aspect, and the ECU 60 executes the processing of steps S204 and S210 described above, whereby "bypass control means" in the aforementioned second aspect is realized. Further, in embodiment 2 described above, the ECU 60 executes the processing of step S210 described above, whereby "enriching means" in the aforementioned third aspect is realized.

REFERENCE SIGNS LIST

10 internal combustion engine
12 head cover
14 valve
16 fresh air introduction path
20 intake manifold
22 throttle valve
24 intercooler
26 turbocharger
27 compressor
28 intake passage upstream section
30 air cleaner
40 PCV path
42 check valve
44 separator
46 path
50 PCV valve
70 path switching valve
72 bypass passage
74 separator
90 pressure sensor
170 check valve
172 spring
174 electromagnetic valve

The invention claimed is:

1. A PCV system for an internal combustion engine, comprising:

a PCV path that allows a crankcase of an internal combustion engine and an intake passage of the internal combustion engine to communicate with each other, and allows blowby gas in the crankcase to pass therethrough;

a bypass passage that is connected in parallel to the PCV path;

a valve that is provided between the PCV path and the bypass passage, and changes a flow path of the blowby gas between the PCV path and the bypass passage;

a separator that is provided in the bypass passage; and control means that controls the valve so that the blowby gas can flow into the bypass passage when the internal combustion engine is operated in a predetermined load range, pressure detecting means that detects pressure in an inside of the crankcase, wherein the control means includes bypass control means that controls the valve so that the blowby gas can flow into the PCV path side when the pressure detected by the pressure detecting means is a predetermined value or more, in a case in which the valve is controlled so that the blowby gas flows to the bypass passage, wherein the control means includes enriching means that makes an air-fuel ratio of the internal combustion engine rich in a case of performing the control by the bypass control means.

2. The PCV system for an internal combustion engine according to claim 1, wherein the control means includes means that determines whether or not a load of the internal combustion engine is a predetermined load or more based on a sensor output value relating to the load of the internal combustion engine, means that determines whether or not an engine speed of the internal combustion engine is in a predetermined speed range, and means that controls the valve to increase an amount of the blowby gas that flows via the bypass passage based on a premise that the internal combustion engine is operated in the predetermined load range when the internal combustion engine is operated under the predetermined load or more and the engine speed is in the speed range.

3. The PCV system for an internal combustion engine according to claim 1, further comprising:

a check valve that is provided in a region where the PCV path and the bypass passage connect to each other in an orientation to cause blowby gas to flow into the bypass passage.

4. The PCV system for an internal combustion engine according to claim 1, wherein the internal combustion engine comprises a supercharger, the supercharger includes a compressor provided midway in the intake passage, the PCV path allows the crankcase of the internal combustion engine, and an upstream section of the compressor in the intake passage of the internal combustion engine to communicate with each other, the PCV system further comprising:

a gas passage that allows a head cover of the internal combustion engine, and the upstream section of the intake passage of the internal combustion engine to communicate with each other;

an opening and closing valve that opens and closes the gas passage; and control means that closes the opening and closing valve when the control means controls the valve so that the blowby gas flows to the bypass passage.

5. The PCV system for an internal combustion engine according to claim 1, wherein the internal combustion engine comprises a supercharger, the supercharger includes a compressor provided midway in the intake passage, the PCV path allows the crankcase of the internal combustion engine, and an upstream section of the compressor in the intake passage of the internal combustion engine to communicate with each other, the PCV system further comprising:

a natural aspiration time PCV path that is a path that allows a downstream section of the compressor of the internal combustion engine and the crankcase of the internal combustion engine to communicate with each other; and a PCV valve that is provided in the natural aspiration time PCV path.

6. The PCV system for an internal combustion engine according to claim 1, wherein the predetermined load range is a load range to such an extent that preignition occurs by oil flowing into a cylinder of the internal combustion engine as a result of the oil taken away from an inside of the crankcase of the internal combustion engine with a flow of blowby gas via the PCV path increasing in response to a load of the internal combustion engine.

7. A PCV system for an internal combustion engine, comprising:

a PCV path that allows a crankcase of an internal combustion engine and an intake passage of the internal combustion engine to communicate with each other, and allows blowby gas in the crankcase to pass therethrough;

a bypass passage that is connected in parallel to the PCV path;

a valve that is provided between the PCV path and the bypass passage, and changes a flow path of the blowby gas between the PCV path and the bypass passage;

a separator that is provided in the bypass passage; and a control unit that controls the valve so that the blowby gas can flow into the bypass passage when the internal combustion engine is operated in a predetermined load range, a pressure detecting unit that detects pressure in an inside of the crankcase, wherein the control unit includes a bypass control unit that controls the valve so that the blowby gas can flow into the PCV path side when the pressure detected by the pressure detecting unit is a predetermined value or more, in a case in which the valve is controlled so that the blowby gas flows to the bypass passage, wherein the control unit includes enriching unit that makes an air-fuel ratio of the internal combustion engine rich in a case of performing the control by the bypass control unit.

* * * * *